US009181727B2

(12) United States Patent
Litwinski

(10) Patent No.: US 9,181,727 B2
(45) Date of Patent: Nov. 10, 2015

(54) LOCK MECHANISM WITH A KEY REMOVAL INTERLOCK AND AN INTERLOCK OF KEY REMOVAL FROM A LOCK MECHANISM

(71) Applicant: Artur Litwinski, Warsaw (PL)

(72) Inventor: Artur Litwinski, Warsaw (PL)

( * ) Notice: Subject to any disclaimer, the term of this patent is extended or adjusted under 35 U.S.C. 154(b) by 0 days.

(21) Appl. No.: 14/500,242

(22) Filed: Sep. 29, 2014

(65) Prior Publication Data

US 2015/0089983 A1 Apr. 2, 2015

(30) Foreign Application Priority Data

Sep. 30, 2013 (PL) ..... 405478

(51) Int. Cl.
*E05B 27/00* (2006.01)

(52) U.S. Cl.
CPC ..... *E05B 27/0003* (2013.01); *Y10T 70/7531* (2015.04)

(58) Field of Classification Search
CPC ..... Y10T 70/7768; Y10T 70/7915; Y10T 70/7944; Y10T 70/7593; Y10T 70/7633; Y10T 70/7864; E05B 11/00; E05B 49/002
USPC ..... 70/358, 367, 369, 419, 421, 389, 403, 70/404
See application file for complete search history.

(56) References Cited

U.S. PATENT DOCUMENTS 913,942 A * 3/1909 Bodge ..... 70/493
3,575,024 A * 4/1971 Schlage ..... 70/389
3,590,615 A * 7/1971 Schultz ..... 70/421
3,656,328 A * 4/1972 Hughes ..... 70/276
4,185,480 A * 1/1980 Pechner ..... 70/358
4,341,102 A * 7/1982 Ku et al. ..... 70/358
4,376,381 A * 3/1983 Muus ..... 70/337
4,770,014 A * 9/1988 Knauer ..... 70/358
4,823,575 A * 4/1989 Florian et al. ..... 70/358
4,838,051 A * 6/1989 Yang ..... 70/38 A (Continued)

FOREIGN PATENT DOCUMENTS

CN 2122198 U 11/1992
CN 2170349 Y 6/1994

(Continued)

OTHER PUBLICATIONS

Poland Patent Office, Search Report, For Priority Application No. PL 05 478, dated Oct. 3, 2013.

*Primary Examiner* — Suzanne Barrett
(74) *Attorney, Agent, or Firm* — Walker & Jocke

(57) ABSTRACT

A lock mechanism has a key removal interlock. The interlock enables removal of the key from the lock in only one angular position. The lock mechanism includes a cylinder (1) which includes an inner sleeve (2) and an outer sleeve (3). The locking components (5) are radially arranged angularly in rows (4) along the axis of the cylinder and are radially movably positioned in channels (6) that extend in the inner sleeve and the outer sleeve. A cylindrical key with decoding elements on an outer surface is usable to unlock the lock mechanism. In one arrangement a plurality of locking components are positioned in the inner sleeve and outer sleeve with different angular spacing between the channels so as to only allow key removal in one angular position. In another arrangement, a plurality of rows of locking components has one row with a number of channels that is different than in the remaining rows so as to only allow key removal in one angular position.

5 Claims, 2 Drawing Sheets

(56) References Cited

U.S. PATENT DOCUMENTS

| | | | | | |
|---|---|---|---|---|---|
| 5,079,936 | A * | 1/1992 | Stefanek | 70/358 |
| 5,148,690 | A * | 9/1992 | Wang | 70/38 A |
| 5,485,735 | A * | 1/1996 | Laabs et al. | 70/358 |
| 5,493,884 | A * | 2/1996 | Hinz et al. | 70/407 |
| 5,531,084 | A * | 7/1996 | Laabs et al. | 70/409 |
| 5,685,184 | A * | 11/1997 | Gallagher | 70/358 |
| 5,775,144 | A * | 7/1998 | Pagalday | 70/358 |
| 5,893,284 | A * | 4/1999 | Hrabal | 70/358 |
| 6,474,122 | B2 * | 11/2002 | Davis | 70/278.3 |
| 6,601,419 | B2 * | 8/2003 | Huang et al. | 70/358 |
| 7,174,757 | B1 * | 2/2007 | Tseng | 70/358 |
| 7,181,937 | B2 * | 2/2007 | Keller | 70/338 |
| 2010/0050716 | A1 * | 3/2010 | Fan | 70/358 |
| 2010/0083718 | A1 * | 4/2010 | Miyake | 70/358 |

FOREIGN PATENT DOCUMENTS

| | | | |
|---|---|---|---|
| CN | 201513008 | U | 6/2010 |
| CN | 201574630 | U | 9/2010 |
| JP | 2010007306 | A | 1/2010 |
| PL | 80220 | | 11/1990 |

* cited by examiner

LOCK MECHANISM WITH A KEY REMOVAL INTERLOCK AND AN INTERLOCK OF KEY REMOVAL FROM A LOCK MECHANISM

It is the object of this invention to provide a lock mechanism with a key removal interlock and an interlock of key removal from a lock mechanism, for lock with a cylinder, enabling key removal in only one angular position.

Lock mechanisms are known where in lock and cylinder bolts mechanisms there are two cooperating sleeve elements in a form of a cylinder, namely an outer sleeve and an inner sleeve. The lock mechanism is housed in a box provided with a gripping part and at least one bolt. In both sleeves radial openings are formed in which locking elements in a form of spring-supported pins are seated. The locking pins are so sized that in a state without a key there is no possibility to rotate the inner sleeve relative to the outer sleeve, and thus to open the lock.

In known lock and cylinder bolt mechanisms, rotation of the internal sleeve relative to the outer sleeve is possible upon setting the positioning of the locking elements in a position where the locking elements are aligned along a division line of both sleeves and this enables rotation of one sleeve relative to the other one and unlocking of the lock.

Such lock mechanisms have locking elements arranged in rows, for example in four rows, spaced radially at 90°. With the mechanism of such a lock a key cooperates that has a cylindrical shank and encoding recesses arranged on its cylindrical surface that set correspondingly the locking elements in the lock mechanism in a form of pins. In order to prevent the pins of locking elements from falling into the inner sleeve in its longitudinal axis a guide is inserted in a form of a shaft fixed to the base of the cylinder.

A disadvantage of this solution is a possibility of removing the key from the lock after its insertion in any of four angular orientations of the outer sleeve relative to the inner sleeve, corresponding to positioning of rows of locking elements in the lock cylinder. This may cause irregularities in locking of the lock, malfunctioning or damage thereof.

It is the object of this invention to provide a solution for a lock mechanism that makes it possible to avoid the above mentioned disadvantages.

A lock mechanism with a key removal interlock according to the invention comprises a cylinder with two concentric sleeves, outer sleeve and inner sleeve, with locking components radially arranged in rows along with the cylinder axis and embedded in channels formed in the inter sleeve and the outer sleeve. The mechanism is unlocked with a key with a cylindrical shank with an internal guiding bore and decoding elements positioned on the outer key surface, cooperating with the locking components. At least two radially angularly spaced rows of locking components are arranged in the inner and outer sleeves 3 with different angular spacing.

Preferably, the angular difference of asymmetric positioning of the rows of locking components is 1° to 5°.

An interlock of key removal from a lock mechanism according to the invention, where the lock comprises a cylinder with two concentric sleeves, inner sleeve and outer sleeve, with locking components radially arranged angularly in rows along the cylinder axis, positioned in channels formed in the inner and outer sleeves. The mechanism is unlocked with a key with cylindrical shank with internal guiding bore and decoding elements positioned on the outer key surface that cooperate with locking components. At least in one row of locking components the number of channels is different than in the remaining rows 4 of locking components.

BRIEF DESCRIPTION OF THE DRAWINGS

The object of the invention is shown in embodiments in the drawing, where.

DETAILED DESCRIPTION

Figure 1:
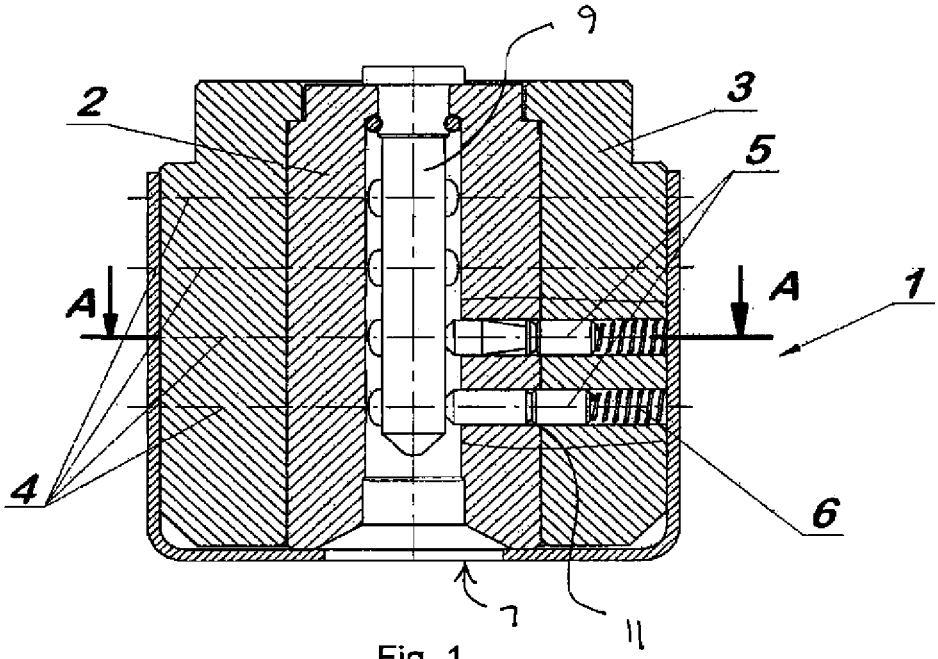
FIG. 1 shows a cylinder of a lock mechanism in longitudinal section.
Figure 2:
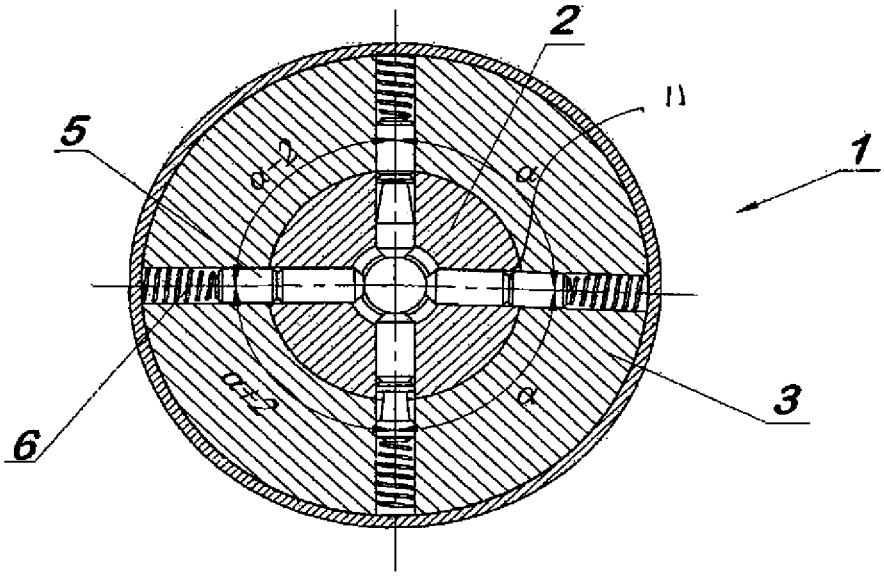
FIG. 2 shows a cylinder of a lock mechanism in cross-section.

FIGS. 1 and 2 show a lock mechanism with a key removal interlock and an interlock of key removal from a mechanism that has a gripping part (not shown) seated on a box (not shown) where two horizontal bolts (not shown) are inserted as well as a cylinder 1.

The cylinder 1 has two sleeves, inner sleeve 2 and outer sleeve 3, positioned coaxially with a central bore. In the sleeves of the cylinder 1, there are radially positioned in rows in openings 4 locking components 5 in a form of pins supported on springs 6. In the embodiment shown at the perimeter of the inner sleeve 2 and at the perimeter of the outer sleeve 3 there are formed four rows of openings 4 in which locking components 5 are positioned in a form of pins supported on springs 6 and having two portions separable along division lines 11.

In the central bore 7 of the cylinder 1 there is axially positioned a guide 9 used to guide a cylindrical key and to support locking components when the key is not inserted in the central bore.

As shown in FIG. 2, in a lock mechanism with a key removal interlock, one of the rows of openings 4 where locking components 5 are positioned is shifted angularly relative to the preceding one in the rotational direction to the axis of the cylinder 1 so that this angle is 90°-2° and with regard to the following row of openings 4 where locking components 5 are placed by an angle of 90°+2°. Such angular shift is maintained for the angularly corresponding rows of opening 4 of the cylinder of the encoding recesses on the cylinder key shank which is intended for this lock. This angular shift causes that the key can be removed in only one angular position of the inner sleeve 2 of the cylinder 1 relative to the outer sleeve 3 of the cylinder 1, where the angular shifts on the key will coincide with the angular shifts of the inner sleeve 2 and the outer sleeve 3 of the cylinder 1.

In the remaining three angular positions the locking components 5 positioned in rows of openings 4 will make it impossible to remove the key, since they will lock the encoding recesses of the key.

Figure 3:
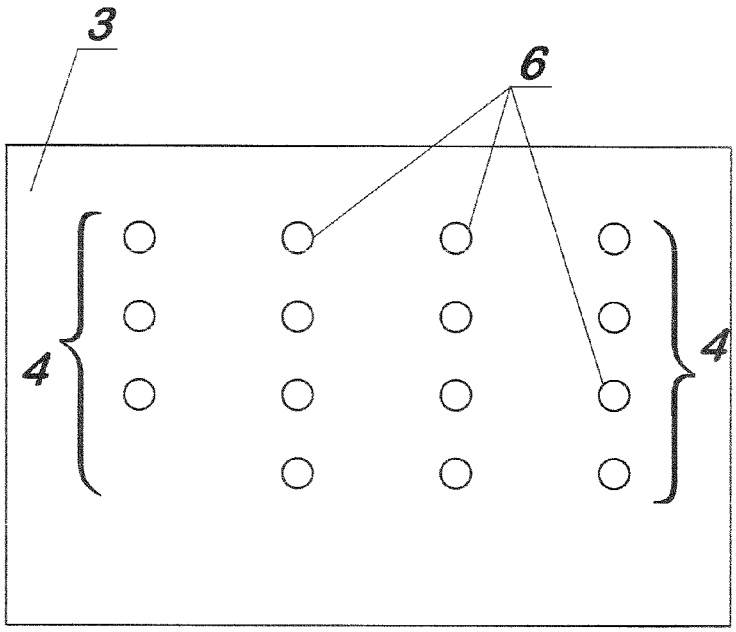
FIG. 3 shows an extension of internal surface of the outer sleeve of a cylinder.

As shown in FIG. 3, in a further embodiment, in an interlock of key removal from a lock mechanism according to the second invention, one of openings 4 in one of rows of openings 4 in which locking components 5 are seated has been eliminated. This opening is absent from the row of openings both in the inner sleeve 2 and in the outer sleeve 3. Absence of one opening 4 for locking components is visible in the extension in FIG. 3 in the outer left-hand row of the extension. If the cylinder is in one of the four positions where the rows of openings 4 for locking elements 5 in the inner sleeve 2 are in one line with the rows of openings 4 for locking elements 5 in the outer sleeve 3, and the row of openings 4 of a lower number of openings 4 in the inner sleeve 2 is not in one line with the row of openings 4 of a lower number of openings 4 in the outer sleeve 3, then the key cannot be removed from the lock, since this is prevented by the locking components 5 in a form of pins supported on springs 6 that in this position have no space to "hide" and thus they will lock the key in its encoding recesses.

I claim:

1. A lock mechanism configured to be changeable between locked and unlocked conditions responsive to engagement of a proper key therewith, wherein the proper key includes a generally cylindrical shank, wherein the shank includes an outer cylindrical surface, wherein the outer cylindrical surface includes an arrangement of decoding elements, wherein the arrangement of decoding elements corresponds to the lock mechanism, and wherein the decoding elements include a plurality of encoding recesses, wherein the lock mechanism is configured to allow the shank of the proper key to be removed from engagement with the lock mechanism only in one particular angular position of the shank, the lock mechanism comprising:

a cylindrical inner sleeve, wherein the inner sleeve includes a cylinder bore that extends along a central cylinder axis, a cylindrical outer sleeve, wherein the outer sleeve is in adjacent concentric relation about the cylinder axis with the inner sleeve, wherein the inner sleeve and the outer sleeve are relatively rotatably movable with respect to one another, a plurality of channels, wherein each of the plurality of channels extends radially with respect to the cylinder axis, wherein each of the plurality of channels extends in both the inner and the outer sleeve, wherein a plurality of channels extend in a plurality of axially spaced radial rows, wherein each radial row extends in a plane perpendicular of the cylinder axis, wherein each of the plurality of radial rows includes a plurality of channels, wherein each channel in a radial row is angularly spaced from each immediately angularly adjacent channel, and wherein each channel in each radial row is axially aligned in an axial row with a corresponding channel in each of the other radial rows of channels, at least one additional radial row of channels, wherein the at least one additional radial row of channels is axially disposed from at least one radial row of channels of the plurality of radial rows, wherein the at least one additional radial row includes a plurality of channels, each of which channels in the at least one additional radial row extend radially relative to the cylinder axis and are aligned in an axial row with channels in each of the plurality of radial rows of channels, with the exception that one channel that would otherwise cause all the channels of the at least one additional row to correspond with all the channels in the plurality of other radial rows, is not present in the at least one additional radial row, a plurality of pins, wherein each pin extends in and is radially movable with respect to a respective channel, wherein each pin includes two separable portions, wherein the two portions are separable from one another at a division line wherein the lock mechanism is configured so that when no key or an improper key is in the cylinder bore, at least some portions of the pins extend in the channels radially intermediate of the inner and outer sleeves such that the inner and outer sleeves are not relatively rotatably movable with respect to one another, and wherein when the shank of the proper key is in the cylinder bore, the encoding recesses are operative to cause the division lines of all the pins to be positioned generally radially intermediate of the inner sleeve and the outer sleeve, wherein the sleeves are relatively radially movable with respect to one another, and wherein the shank of the proper key is disengageable from the cylinder bore only in the one particular angular position in which all of the plurality of channels in the inner and outer sleeves in all of the radial rows are in radial alignment.

2. The lock mechanism according to claim 1 wherein four angularly spaced channels extend in each radial row.

3. The lock mechanism according to claim 1 and further including a guide, wherein the guide is generally cylindrical and extends coaxially along the cylinder axis, wherein the shank of the proper key includes a bore, and wherein the guide is configured to extend in relative rotatable relation within the bore.

4. The lock mechanism according to claim 3 and further including a plurality of springs, wherein each spring extends in a respective channel, and wherein each spring is operative to bias a respective pin radially inward relative to the cylinder axis.

5. The lock mechanism according to claim 4 wherein the plurality of springs is operative to cause each one of the plurality of pins to engage the guide when the shank of the proper key is not in the cylinder bore.

* * * * *